US005970624A

United States Patent [19]

Moriya

[11] Patent Number: 5,970,624

[45] Date of Patent: Oct. 26, 1999

[54] METHOD OF DRYING WOOD AND METHOD OF SUBJECTING WOOD TO IMPREGNATIVE TREATMENT

[75] Inventor: Kazuo Moriya, Tokorozawa, Japan

[73] Assignee: Common Facility Co-Operatives Forest Nishikawa, Saitama-ken, Japan

[21] Appl. No.: 08/973,262

[22] PCT Filed: Jun. 4, 1997

[86] PCT No.: PCT/JP97/01895

§ 371 Date: Dec. 3, 1997

§ 102(e) Date: Dec. 3, 1997

[87] PCT Pub. No.: WO97/46358

PCT Pub. Date: Dec. 11, 1997

[30] Foreign Application Priority Data

Jun. 4, 1996 [JP] Japan ..... 8-141691
Jun. 2, 1997 [JP] Japan ..... 9-144340

[51] Int. Cl.[6] ..... F26B 5/04

[52] U.S. Cl. ..... 34/411; 34/396

[58] Field of Search ..... 34/92, 396, 402, 34/403, 404, 405, 409, 411, 412, 415

[56] References Cited

U.S. PATENT DOCUMENTS

| | | | |
|---|---|---|---|
| 3,986,268 | 10/1976 | Koppelman | 34/92 |
| 4,345,384 | 8/1982 | Pagnozzi et al. | 34/92 |
| 4,466,198 | 8/1984 | Doll | 34/92 |

FOREIGN PATENT DOCUMENTS

| | | |
|---|---|---|
| 60-248312A | 12/1985 | Japan . |
| 3-173604A | 7/1991 | Japan . |
| 6-262604A | 9/1994 | Japan . |
| 6-297408A | 10/1994 | Japan . |
| 2-98404A | 4/1996 | Japan . |

OTHER PUBLICATIONS

PCT International Search Report, Aug. 26, 1997.

*Primary Examiner*—Henry Bennett
*Assistant Examiner*—Pamela A. Wilson
*Attorney, Agent, or Firm*—Jenkens & Gilchrist, P.C.

[57] ABSTRACT

The invention aims to provide a lumber drying method which can dry lumbers in a short period without causing cracks and a lumber impregnation method to permeate processing agents deep into the lumbers at a low cost. The lumber drying method comprises a process to place lumbers in an airtight container and to heat them, a process to vacuum the inside of the airtight container, and a process to restore the air pressure after the vacuuming process. And, the lumber impregnation method comprises a process to heat lumbers, a process to place the heated lumbers under a vacuumed pressure, a process to immerse the heated lumbers in processing agents under the vacuumed pressure, and a process to restore the pressure of the lumbers immersed in the processing agents under the vacuumed pressure to the air pressure, and to immerse the lumbers in the processing agents under the air pressure.

17 Claims, 3 Drawing Sheets

METHOD OF DRYING WOOD AND METHOD OF SUBJECTING WOOD TO IMPREGNATIVE TREATMENT

This is a 371 of PCT/JP97/01895 filed Jun. 4, 1997.

BACKGROUND OF THE INVENTION

1. Field of the Invention

The present invention relates to a lumber drying method and an impregnation processing method to have the lumber absorb various agents such as preservative, mothproofingg agent, preservative/mothproofing agent, anti-ant agent, anti-fungus agent, dimensional stabilizer and resin.

2. Related Art

As shown in FIG. 3, lumbers are conventionally dried, for example, by a drying apparatus 1 consisting of a drying chamber 2 to accommodate lumbers 6, a heating boiler 3 to send heated air into the drying chamber 2, heat stirrers 4 installed in the drying chamber 2 and an exhaust pipe 5 to discharge the water vapor generated from the lumbers 6.

The lumbers 6 are, for example, placed on a carriage 7 and accommodated in the drying chamber 2. These lumbers 6 are cedars having an end face of about 105 mm×105 mm and a length of 3 to 4 m. The lumbers 6 are piled up on the carriage 7 with inserting a 1 to 2 cm thick spacer 8 between each pair of lumbers. Further, the initial moisture content of the lumber 6 is 50 to 70%.

The drying apparatus 1 maintains the temperature in the drying chamber 2 at 60 to 70° C. with the heated air sent from the heating boiler 3 to dry the lumbers 6. Drying by this apparatus is continued for 15 to 20 days. The final moisture content is 15 to 20%.

According to the conventional lumber drying method as shown in FIG. 3, however, the heated air is discharged to outside via the exhaust 5 together with the water vapor from the lumbers 6, which makes the energy cost expensive.

Another drawback is that variation of the water vapor in the drying chamber 2 prevents uniform drying of the lumbers 6.

Further, the heated air drying may cause crack in lumbers 6 when the temperature is raised.

In addition, long drying time (15 to 20 days) means that the apparatus can be used only once or twice a month.

The lumber is inferior to other materials in its dimensional stability, uniformity, preservability, moth-proof, flame retardancy and strength. To improve such drawbacks of lumber and to add functions, the lumber is made composite with chemicals by impregnation. For example, large wooden products such as telephone poles and railroad ties are impregnated for preservation and moth-proof processing.

On the other hand, under the situation with shortage of lumber resources and lower prices in international competition, improvement of unused wood species and low quality wood, development of high durability technology and wooden product manufacturing by such methods are eagerly awaited.

In particular, it is expected that woods are improved or provided with new functions for higher additional values in the field of building materials, furniture members and art objects.

As a conventional method to improve drawbacks of or add functions to lumbers, the impregnation method to have the lumber absorb the agent has been known.

Impregnation methods include vacuum/pressure injection, compression and pressurizing methods. Vacuum/pressure injection methods are, for example, disclosed in Chapter II "Research on Function Enhancement by High Impregnation of Lumbers" contained in researches about processing of wooden members for higher functions issued by the Small and Medium Enterprise Agency in October 1990, the article titled "Pressurized Injection Conditions and Their Characteristics in Impregnation of Lumbers" in Vol. 28 of the Research Report from Shimane Prefectural Industrial Engineering Center (1991), and "Lumber Storage (1)—Focusing on Processing Technology—" in "Lumber Industry" Vol. 49, No. 7, 1994.

The vacuum/pressure impregnation method repeats pressurizing and vacuuming to impregnate the lumber with the processing agent.

The above article "Pressurized Injection Conditions and Their Characteristics in Impregnation of Lumbers" has made impregnation of lumbers with the injection conditions changed as follows: 1) Temperature, pressurizing force and pressurizing time of the injection system; 2) Combination of processes such as repetition of vacuuming and pressurizing; and 3) Pressure atmosphere before injection. It is reported that the following results are obtained about these factors.

1) Time and pressure have direct correlations with the injection amount. Temperature affects little in practice.
2) Combination method of vacuuming and pressurizing did not distinctively affect the injection amount and impregnation cross section.
3) The lower the pressure atmosphere before injection is, the more the injection amount becomes, and the impregnation is substantially affected by the injection time. But, the higher, the pressure atmosphere before injection, the deeper the impregnation becomes for the injection amount.

As a compression method, the method disclosed in "Liquid injection into hardly permeable lumbers by compression method" in Nara Prefectural Experimental Forestry Station Report No. 21 (1991), for example, is known. According to this method, the lumber is pressed and crushed in radial direction before pressurized injection for improvement of liquid permeability. In this compression method, it is found that compression in air-dried state before pressurized injection is effective for improvement of permeability at least for small test pieces.

Further, as a pressurizing method, the method disclosed in "Lecture: Mothproofing of Lumbers (13), Mothproofing, Pressurizing Method" in Vol. 33-5 of "Lumber Industry", for example, is known.

According to the pressurizing method, after putting the lumbers in an injection case and sealing it, chemicals required for preservation, mothproof and dyeing are injected under the pressure of 10 to 15 kgf/cm$^2$ in one to ten odd hours.

The pressurizing method is widely used as a method to have the lumber absorb the largest quantity of chemicals. In particular, railroad ties, telephone poles and base lumbers to be used outdoors for a long time are subjected to pressurized impregnation of preservation agent for a longer service life.

The absorption amount in this method is much larger than that in application, spraying and immersing. Since sufficient absorption and infiltration length can be achieved, this is the most effective processing method.

However, the conventional lumber impregnation methods as described above have drawbacks of necessity of quite costly processing equipment and low production efficiency.

In addition, there is a concern that cells might be destroyed during processing.

Besides, due to difference in permeability of the processing agent depending on species, individual lumbers and sections, it is difficult to uniformly impregnate processing agents deep into the lumbers by the conventional methods.

SUMMARY OF THE INVENTION

The present invention has been made to solve the drawbacks of conventional methods as above. It is an object of the present invention to provide a lumber drying method which can dry lumbers in a short period without causing cracks.

It is another object of the present invention to provide a lumber impregnation method to permeate processing agents deep into lumbers at a low cost.

A preferred embodiment of the present invention comprises a process to place lumbers in an airtight container and to heat them, a process to vacuum the inside of the airtight container, and a process to restore the air pressure after the vacuuming process.

A further embodiment of the present invention is characterized by the lumber drying method wherein heating and vacuuming are performed at the same time.

A further embodiment of the present invention is characterized by the lumber drying method wherein the process for air pressure restoration is made in a moment by opening of a pressure relief valve of the airtight container.

A further embodiment of the present invention is characterized by the lumber drying method wherein the lumber has a moisture content of about 10 to 15% (corresponding to the equilibrium moisture content).

A further embodiment of the present invention is characterized by the lumber drying method wherein the lumber heating process heats the lumber until the surface temperature reaches 50 to 150° C.

A further embodiment of the present invention is characterized by the lumber drying method wherein the vacuuming process has a vacuuming force of about 60 cm/Hg or more and vacuuming time of at least one hour.

A further embodiment of the present invention is characterized by the lumber drying method wherein heat and water vapor are distributed in the airtight container by stirring with a fan inside the container during heating process or heating/vacuuming process.

Another preferred embodiment of the present invention process to place the heated lumbers under a vacuumed pressure, a process to immerse the heated lumbers in processing agents under the vacuumed pressure, and a process to restore the pressure of the lumbers immersed in the processing agents under the vacuumed pressure to the air pressure and to immerse the lumbers in the processing agents under the air pressure.

Another preferred embodiment of the present invention comprises a process to heat lumbers, a process to place the heated lumbers under a vacuumed pressure, a process to return the lumbers under the vacuumed pressure to under the air pressure, a process to heat the lumbers again, a process to place the reheated lumbers under a vacuumed pressure, a process to immerse the reheated lumbers into processing agents under the vacuumed pressure, and a process to restore the atmospheric pressure of the lumbers immersed in the processing agents under the vacuumed pressure to the air pressure and to immerse the lumbers in the processing agents under the air pressure.

A further embodiment of the present invention is characterized by the lumber impregnation method wherein the lumber heating process heats the lumber until the surface temperature reaches 60 to 150° C.

A further embodiment of the present invention is characterized by the lumber impregnation method wherein the process to place the heated lumbers under a vacuumed pressure has a vacuuming force of about 60 cm/Hg or more and vacuuming time of at least one hour.

A further embodiment of the present invention is characterized by the lumber impregnation method wherein the air pressure restoration process is made in a moment.

A further embodiment of the present invention is characterized by the lumber impregnation method wherein the heating process or the heating/vacuuming process stirs the air with a fan to distribute the heat and water vapor in a processing apparatus.

A further embodiment of the present invention is characterized by the lumber impregnation method wherein the lumber reheating process and the process to place the reheated lumbers under the vacuumed pressure are repeated at least once.

A further embodiment of the present invention is characterized by the lumber impregnation method wherein the lumbers are, after the processing agent immersing process under the air pressure, pressurized in a processing apparatus.

Another preferred embodiment of the present invention comprises an airtight container with an opening/closing lid, a heating device to heat the air in the airtight container, a thermometer to measure the temperature in the airtight container, a pressure gauge to measure the pressure in the airtight container, a stirring device to stir the heat in the airtight container, a pressure relief valve provided on the airtight container, a vacuuming pump provided on the airtight container, and a dew water drainage opening formed on the airtight container via an opening/closing valve.

Another preferred embodiment of the present invention comprises an airtight container with an opening/closing lid, a heating device to heat the air in the airtight container, a thermometer to measure the temperature in the airtight container, a pressure gauge to measure the pressure in the airtight container, a stirring device to stir the heat and water vapor in the airtight container, a pressure relief valve provided on the airtight container, a vacuuming pump provided on the airtight container, a dew water drainage opening formed on the airtight container via an opening/closing valve, and a processing agent container provided on the airtight container via an opening/closing valve.

A further embodiment of the present invention is characterized by the lumber impregnation apparatus wherein the airtight container is provided with a pressurizing pump and a pressure gauge.

According to the invention as set forth in the embodiments described hereinabove, lumbers with a moisture content of 10 to 15% (corresponding to equilibrium moisture content) are first placed in the airtight container and the air in the airtight container is stirred by a fan, so that the surface temperature of the lumbers in the airtight container becomes 50 to 150° C. And, the temperatures inside and outside of the lumber become almost the same in about two hours.

During heating or after stop of heating, the atmospheric pressure in the airtight container is vacuumed. In this vacuuming process, a vacuuming force is about 60 cm/Hg or more and a vacuuming time is at least one hour.

At this point, a vacuum is formed inside the airtight container. However, heating causes water vapor, which further causes saturation so that the heat is spread to every corner. The saturated water vapor becomes water drops to accumulate on the bottom of the airtight container.

Then, the pressure opening/closing valve is immediately opened so that the pressure in the airtight container is restored to the air pressure.

Thus, dry lumbers with a final moisture content of 5 to 10% can be obtained.

According to the invention as set forth in the embodiments described hereinabove, lumbers with a moisture content of 50 to 70% (are first placed in the airtight container and the air in the airtight container is stirred by a fan, so that the surface temperature of the lumbers in the airtight container becomes 50 to 100° C.

During heating or after stop of heating, the atmospheric pressure in the airtight container is vacuumed. In this vacuuming process, a vacuuming force is about 60 cm/Hg or more and a vacuuming time is two to three days.

At this point, a vacuum is formed inside the airtight container. However, heating causes water vapor, which further causes saturation so that the heat is spread to every corner. The saturated water vapor becomes water drops to accumulate on the bottom of the airtight container.

Then, the pressure control valve is immediately opened so that the air pressure is restored in the airtight container.

Thus, dry lumbers with a final moisture content of 10 to 20% can be obtained.

Explaining the relation between the drying and the temperature, the boiling point of the water under the normal air pressure is 100° C., but the water does not boil unless the temperature becomes 110 to 120° C. when the air pressure at the center of the lumbers rises due to heating. This means that the drying efficiency is improved as compared with conventional hot-air drying.

According to the invention as set forth in the embodiments described hereinabove, lumbers with a moisture content of 10 to 15% (corresponding to equilibrium moisture content) are first placed in the airtight container and heated until the surface temperature of the lumbers becomes 50 to 150° C. in the airtight container. It seems that, during such heating, paths are formed through stomata in lumber cells.

During heating or after stop of heating, the atmospheric pressure in the airtight container is vacuumed. In this vacuuming process, a vacuuming force is about 60 cm/Hg or more and a vacuuming time is at least one hour.

After such vacuuming, water soluble processing agents such as preservative, mothproofing agent, preservative/mothproofing agent, anti-ant agent, anti-fungus agent, dimensional stabilizer, resin (with low molecular weight) and functional resin are injected and the lumbers are immersed into the processing agents.

Then, the pressure in the airtight container is restored to the air pressure. This pressure difference causes the processing agents to permeate into the lumbers via the paths which seem to have been formed through stomata in cells.

According to the invention as set forth in the embodiments described hereinabove, heating and vacuuming is executed again before the processing agent immersing process in the invention as set forth in the embodiments described hereinabove above.

This improves permeability of processing agents during immersing in the processing agent.

According to the invention as set forth in the embodiments described, the lumbers after impregnation under the air pressure are further impregnated with the processing agents.

Processing agents for material improvement can be largely classified into water-soluble processing agents and oil-soluble processing agents. It is easier to handle the water-soluble processing agents.

Though the above operation has been described for a case using a single airtight container for heating process, vacuuming process and immersing process, the respective processes can be continuously processed using a conveying device such as a belt conveyor, for example.

In the case of such a continuous processing, it is not necessary to have an airtight state for the heating process.

BEST MODE FOR CARRYING OUT THE INVENTION

Embodiment 1

Figure 1:
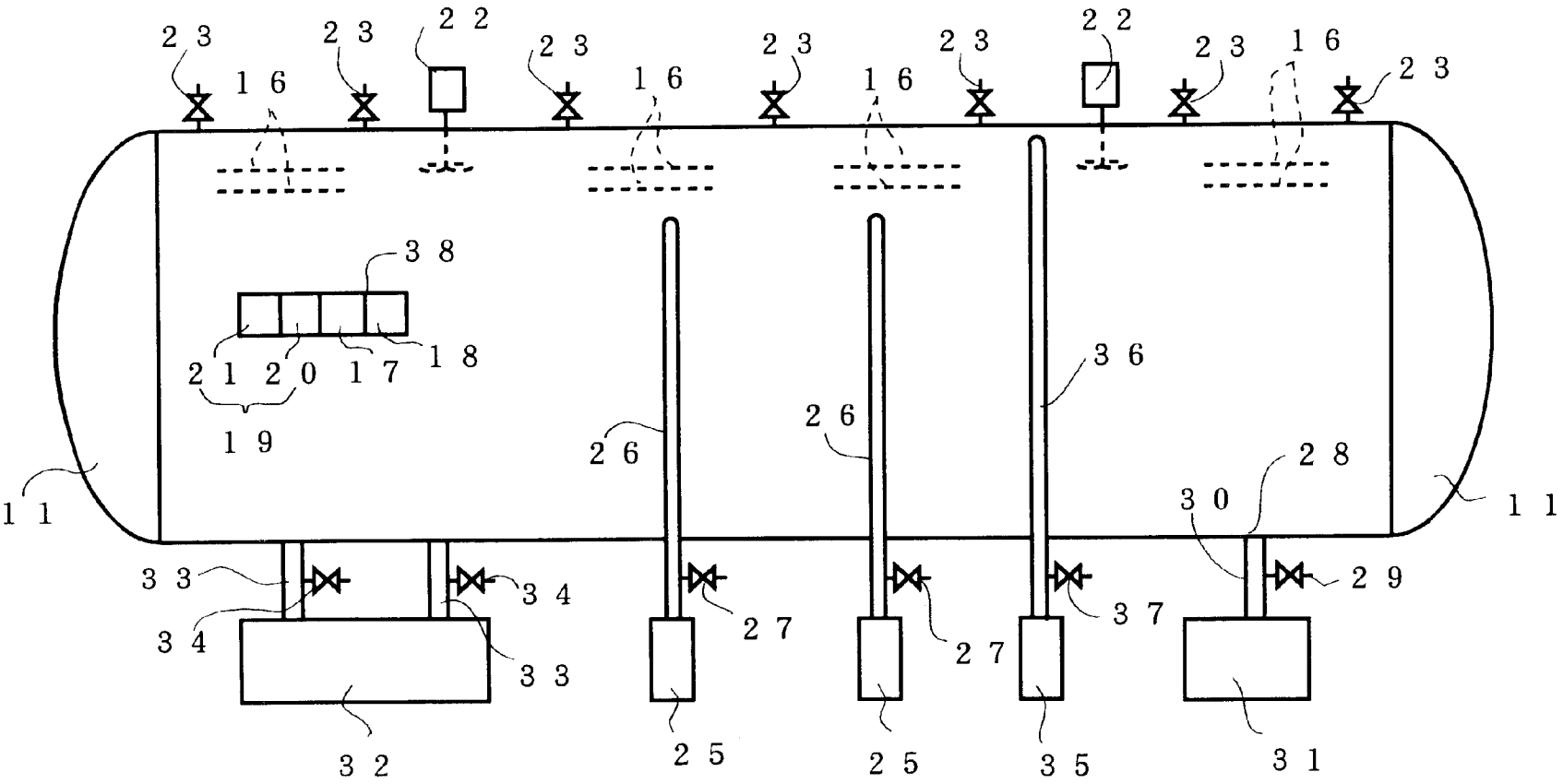
FIG. 1 is an explanatory view to show an apparatus for drying and impregnation of lumbers according to an embodiment of the present invention.
Figure 2:
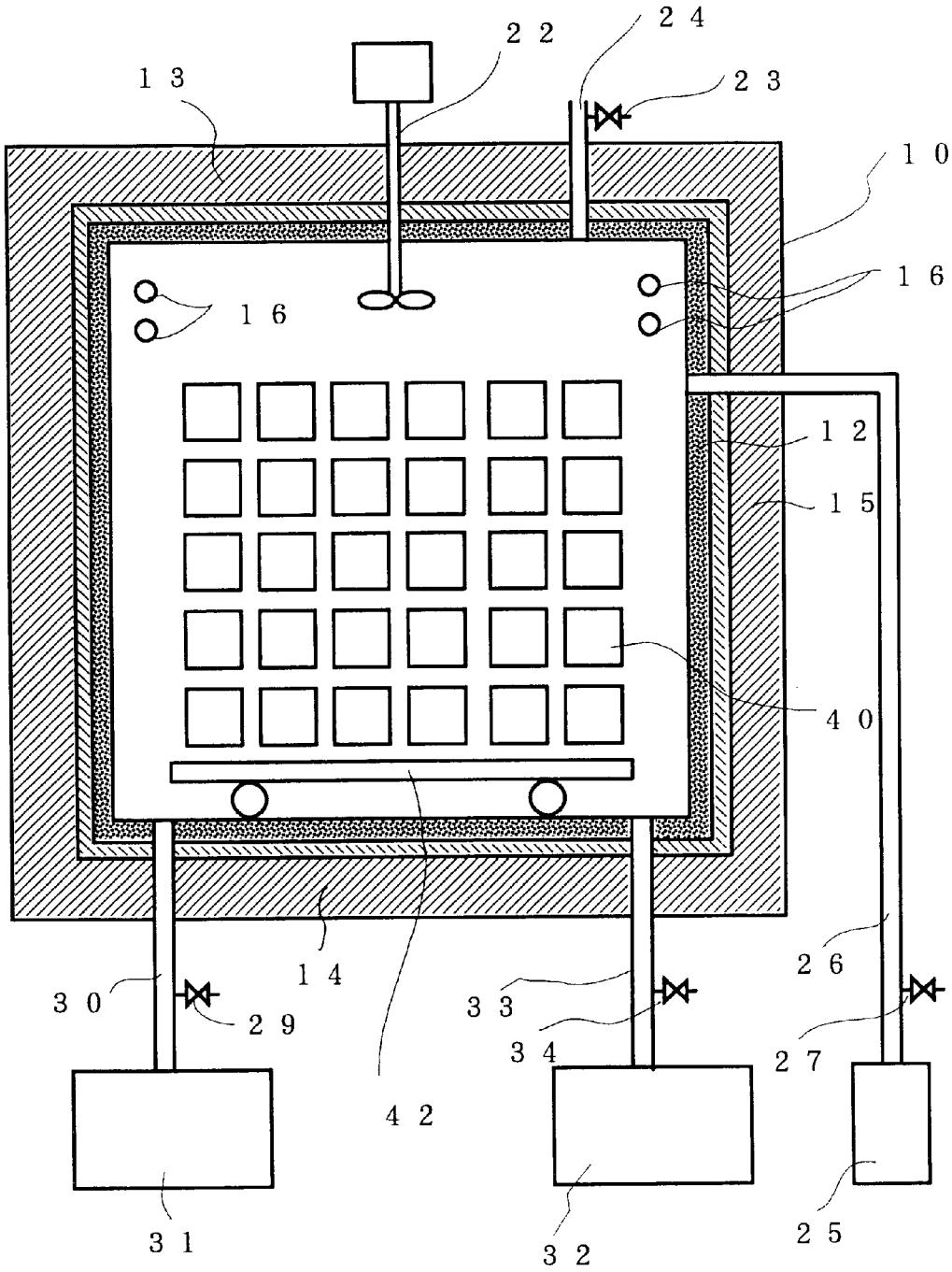
FIG. 2 is a cross sectional view of the apparatus shown in FIG. 1.

FIG. 1 and FIG. 2 show the apparatus for drying and impregnating lumbers according to the invention.

This apparatus comprises an airtight container 10 which has an opening/closing lid with a spherical surface at its both ends, heating devices 16 for heating the air in the airtight container 10, a thermometer 18 for measuring the temperature in the airtight container 10, a pressure gauge 19 for measuring the pressure in the airtight container 10, stirring devices 22 for stirring the heat and water vapor in the airtight container 10, pressure relief valves 23 installed on the airtight container 10, vacuuming pumps 25 mounted on the airtight container 10, a dew water drainage opening 28 which is formed on the airtight container 10 via an on-off valve 29, a processing agent container 32 which is disposed on the airtight container 10 through on-off valves 34, a pressurizing pump 35 mounted on the airtight container 10, and a pressure gauge 21 mounted on the airtight container 10.

The airtight container 10 is configured to resist 5 atmospheric pressures, so that it is designed to have a square cross section to enable its manufacturing. The opening/closing lid 11 is configured to be mounted on both ends of the airtight container 10 by, for example, a well-known means such as a hinge, to secure an airtight state by a well-known locking means.

And, a heat insulating material 12 is formed on the inner surface of the airtight container 10.

The heating device 16 is an electric heater which is mounted to a ceiling 13 of the airtight container 10. This heating device 16 is communicated with a sensor 17, which is fitted to a panel 38 disposed on the outer surface of the airtight container 10, and also connected to a power source (not shown) through a switch.

The thermometer 18 is fitted to the panel 38 disposed on the outer surface of the airtight container 10 and indicates the temperature in the airtight container 10 corresponding to a signal from the sensor which detects the temperature within the airtight container 10.

The pressure gauge 19 is fitted to the panel 38 disposed on the outer surface of the airtight container 10 and indicates the pressure in the airtight container 10 corresponding to a signal from the sensor which detects the pressure in the airtight container 10 through a vacuum gauge 20 and the pressure gauge 21.

The stirring device 22 is an electric fan which is mounted on the ceiling 13 of the airtight container 10. This stirring device 22 is connected to a power source (not shown) via a switch.

The pressure relief valves 23 are fitted to the atmosphere sides of a plurality of tubes 24 which run through the ceiling 13 of the airtight container 10 to communicate the inside and outside of the airtight container 10. The pressure relief valve 23 is a well-known pressure relief valve such as a manual relief valve or a solenoid relief valve.

The vacuuming pump 25 is used to reduce the pressure in the airtight container 10 and may be a vacuum pump for example. The vacuuming pumps 25 are communicated with the inside of the airtight container 10 by means of pipes 26 having on-off valves 27 running through a side wall 15 of the airtight container 10.

The dew water drainage opening 28 is connected to a tube 30 which has an on off valve 29 on the atmosphere side and is disposed on a bottom 14 of the airtight container 10. The dew water drainage opening 28 is communicated with a drainage tank 31 through the tube 30.

The processing agent container 32 is communicated with the airtight container 10 through tubes 33 which have the on-off valve 34 on the atmosphere side and are disposed on the bottom 14 of the airtight container 10.

The pressurizing pump 35 is to increase the pressure in the airtight container 10 and its examples include a pressure pump. The pressurizing pump 35 is communicated with the inside of the airtight container 10 through a pipe 36 having an on-off valve 37, which is through the side wall 15 of the airtight container 10.

Now, description will be made of drying of lumbers by means of the apparatus configured as described above.

First, the on-off valve 34 communicated with the processing agent container 32 is closed, and the on-off valve 37 communicated with the compression pump 35 is also closed.

The opening/closing lid 11 is opened to place lumbers 40 having a moisture content of 10 to 15% (corresponding to the equilibrium moisture content) into the airtight container 10. The lumbers 40 are placed on a carriage 42 in the same manner as the conventional drying method.

The opening/closing lid 11 is closed, and the interior of the airtight container 10 is heated by the heating devices 16. Then, the stirring devices 22 are driven to stir the interior of the airtight container 10 to keep the temperature in the airtight container 10 at 50 to 100° C.

And, the on-off valves 27 are opened while heating or after stop of heating to reduce the atmospheric pressure in the airtight container 10 by running the vacuuming pump 25. This vacuuming process has a vacuuming force of about 60 cm/Hg or more and a vacuuming time of two hours or more.

At the time, the interior of the airtight container 10 is vacuum, but water vapor is produced by heating and saturated to transfer heat to every corner of the airtight container 10. And, the saturated water vapor becomes water drops to accumulate on the bottom of the airtight container 10.

Then, the pressure relief valves 23 are immediately opened to recover the atmospheric pressure in the airtight container 10.

Thus, the dry lumbers obtained have a final moisture content of 5 to 10%.

The water drops accumulated on the floor of the airtight container 10 flow into the drainage tank 31 through the dew water drainage opening 28 upon opening of the on-off valve 29.

In this embodiment, since the lumbers 40 which had a moisture content of 10 to 15% (corresponding to the equilibrium moisture content) were undergone heating and vacuuming in the airtight container 10, they could be dried absolutely (a state close to a water content of zero).

Besides, there is an advantage that the lumbers do not get cracks.

Since this embodiment can provide lumbers which are dried to have a final moisture content of 5 to 10% in one to three days, drying operation can be made 8 to 10 times a month as compared with once or twice a month by a conventional drying method.

To make drying more efficiently, it is desirable to make pretreatment to spray water to the lumbers 40 to produce water vapor so that the interior of the airtight container 10 is easy to have a saturated state of water vapor.

And, hot water vapor may be charged into the airtight container 10 at the early stage of the treatment to save time.

In addition to the electric heater used as the heating device 16, an infrared heater, infrared lamp, high frequency or microwave may be used. Examples of the high frequency include a high frequency oven in which lumbers may be piled up in intimate contact to one another without any spacer.

And, the same effect can also be obtained by only the heating process without reducing the pressure in which the temperature in the airtight container 10 is kept at about 110° C. and one of the pressure relief valves 23 is kept open to prevent the inner pressure from being increased by water vapor.

The invention can also dry the lumbers having a moisture content of 50 to 70%.

In that case, the treatment is performed in the same way as the lumber drying described above excepting that the heating temperature is set to 50 to 100° C. and the treating time is set to two to three days. Thus, the lumbers dried to have a final moisture content of 10 to 20% can be obtained.

Now, an impregnation process of lumbers by means of the apparatus of this embodiment will be described.

First, the opening/closing lid 11 is opened to place the lumbers 40 having a moisture content of 10 to 15% (corresponding to the equilibrium moisture content) into the airtight container 10. The lumbers 40 are placed on the carriage 42 in the same manner as the conventional drying method.

The opening/closing lid 11 is closed, and the interior of the airtight container 10 is heated by the heating devices 16. Then, the stilling devices 22 are driven to stir the interior of the airtight container 10 to keep the surface temperature of the lumbers 40 at 50 to 100° C. in the airtight container 10.

And, the on-off valves 27 is opened while heating or after stop of heating to reduce the atmospheric pressure in the airtight container 10 by running the vacuuming pump 25. This vacuuming process has a vacuuming force of about 60 cm/Hg or more and a vacuuming time of one hour or more.

At the time, the interior of the airtight container 10 is vacuum, but water vapor is produced by heating and saturated to transfer heat to every corner of the airtight container 10. And, the saturated water vapor becomes water drops to accumulate on the bottom of the airtight container 10.

After the vacuuming process, the on-off valves 34 are opened to charge water soluble agents such as preservative, moth proofing agent, preservative/moth-proofing agent, anti-ant agent, anti-fungus agent, dimensional stabilizer, resin (with low molecular weight) and functional resin from the processing agent container 32 into the airtight container 10 to immerse the lumbers 40 in the processing agents.

Then, the pressure relief valves 23 are opened immediately to restore the pressure in the airtight container 10 to the atmospheric pressure. This pressure difference causes the processing agents to permeate into the lumbers via the paths which seem to have been formed through stomata in lumber cells.

By heating and vacuuming again in the previous step of the processing agent immersing process, permeability of the processing agents during immersing is improved.

And, after the processing agent immersing process, the relief valve 17 is opened and the pressure in the airtight container 10 is increased by running the pressurizing pump 35. Thus, permeability into the lumbers 40 is further improved.

Now, Embodiments 2 to 5 will described on the impregnation processing method of lumbers according to the invention.

Tap water was used instead of the processing agent in these embodiments to assure that the amount of tap water permeated into the lumbers was increased. It is to be understood that the same effect can be obtained with the processing agent.

Embodiment 2

A cryptomeria (A) having a moisture content of 10 to 15% (corresponding to the equilibrium moisture content) was cut to a size of 30 mm thick, 60 mm wide and 300 mm long and placed into an airtight container of 1000 mm high, 1000 mm wide and 4000 mm long, and heated to have the lumber surface temperature of 50° C., 80° C., 110° C., and 150° C. under the conditions in accordance with the heating-vacuum test shown in Table 1. Heating time was set to 30, 60, 120 and 180 minutes.

After the heating process, the interior of the airtight container was vacuumed by a vacuum pump and kept to have the atmospheric pressure having a vacuuming force of 60 cm/Hg for 120 minutes.

But, when the heating temperature was 150° C., the lumber was kept under the atmospheric pressure of a vacuuming force of 60 cm/Hg for 180 minutes.

Then, tap water was charged into the airtight container to immerse the lumber in tap water.

The airtight container was then opened to change the pressure in the container to have the air pressure. This condition was retained for four hours.

In Table 1, the "cut end treatment" means that both cut ends are sealed with an epoxy resin to prevent the cut ends from absorbing water wherethrough, "No" means that no cut end treatment was performed, and "Yes" means that the cut end treatment was made.

And, the impregnated amount was determined by allowing the impregnation treated test piece to stand in the saturated water vapor atmosphere at room temperature to let the excess tap water ooze out of the test piece and measuring a weight of the test piece.

Now, description will be made with reference to Table 1.

First, the impregnation processing treatment without making the cut end treatment will be described.

A test lumber was immersed in water at normal temperature (20° C.) for four hours, and its impregnated amount was found to be 0.21g/cm$^3$.

Meanwhile, when the cut ends were not treat as in this embodiment, the test lumber having the surface temperature of 100° C. had the impregnated amount of 0.32 g/cm$^3$ in heating time of 30 minutes, 0.53 g/cm$^3$ in heating time of 60 minutes, and 0.58 g/cm$^3$ in heating time of 120 minutes.

Figure 3:
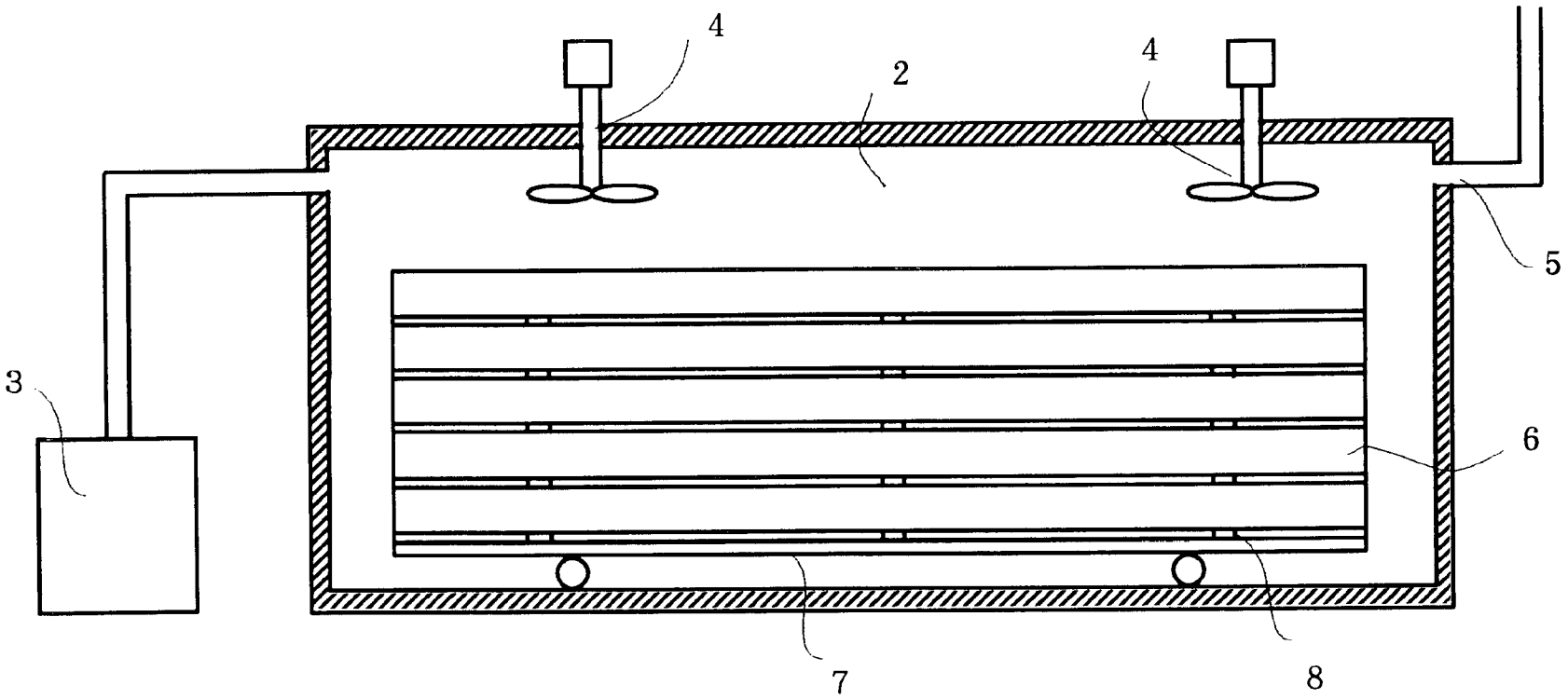
FIG. 3 is an explanatory view to show a conventional lumber drying apparatus.

Here, the impregnated amounts in the heating time of 30 and 120 minutes correspond to the impregnated amounts of 0.5 to 0.6 g/cm$^3$ shown in FIG. 3 in the above-described article titled "Pressurized Injection Conditions and Their Characteristics in Impregnation of Lumbers" in Vol. 28 of the Research Report from Shimane Prefectural Industrial Engineering Center (1991).

Now, the impregnation processing treatment with the cut ends treated will be described.

When the cut ends were treated, a test piece having the surface temperature of 50° C. had an impregnated amount of 0.21 g/cm$^3$ in heating time of 30 minutes, 0.20 g/cm$^3$ in heating time of 60 minutes, and 034 g/cm$^3$ in heating time of 120 minutes; a test piece having the surface temperature of 80° C. had an impregnated amount of 0.25 g/cm$^3$ in heating time of 30 minutes, 0.26 g/cm$^3$ in heating time of 60 minutes, and 0.35 g/cm$^3$ in heating time of 120 minutes; a test piece having the surface temperature of 110° C. had an impregnated amount of 0.20 g/cm$^3$ in heating time of 30 minutes, 0.28 g/cm$^3$ in heating time of 60 minutes, and 0.21 g/cm$^3$ in heating time of 120 minutes; and a test piece having the surface temperature of 180° C. had the impregnated amount of 0.43 g/cm$^3$ in heating time of 180 minutes.

The impregnated amounts in the heating time of 50, 80, 110 and 120 minutes obtained above were better than the preferable values 0.14 to 0.19 g/cm$^3$ (vacuuming: 80 cm/Hg, pressurizing: 10 kg/cm$^2$) among the impregnated amounts with the cut ends treated shown in FIG. 6 in the above-described article titled "Pressurized Injection Conditions and Their Characteristics in Impregnation of Lumbers" in Vol. 28 of the Research Report from Shimane Prefectural Industrial Engineering Center (1991).

In view of above, it was made certain that the impregnated amount with a vacuuming-pressurizing method level was obtained according to this embodiment.

TABLE 1

| Wood type | Cut end treatment | Heating temp. (° C.) | Heating time (min.) | Impregnated amount (g/cm$^3$) | Quantity of test lumber |
|---|---|---|---|---|---|
| Cryptomeria A | No | Normal temp. (20) | — | 0.21 | 3 |
| | | | 60 | | |
| | | | 120 | | |
| | | 50 | 30 | 0.28 | 1 |
| | | | 60 | 0.33 | 1 |
| | | | 120 | 0.33 | 1 |
| | | 80 | 30 | | |
| | | | 60 | | |
| | | | 120 | | |
| | | 10 | 30 | 0.32 | 2 |
| | | | 60 | 0.53 | 2 |
| | | | 120 | 0.58 | 2 |
| | Yes | Normal temp. (20) | — | | |
| | | | 60 | | |
| | | | 120 | | |
| | | 50 | 30 | 0.21 | 2 |
| | | | 60 | 0.20 | 3 |
| | | | 120 | 0.34 | 2 |
| | | 80 | 30 | 0.25 | 2 |
| | | | 60 | 0.26 | 2 |
| | | | 120 | 0.35 | 2 |
| | | 110 | 30 | 0.20 | 2 |
| | | | 60 | 0.28 | 2 |
| | | | 120 | 0.21 | 2 |
| | | 150 | 180 | 0.43 | 4 |

(Note)
Vacuuming conditions: Vacuuming force of 60 cm/Hg and vacuuming time of 120 minutes
Immersing time: Four hours
Vacuuming time is 180 minutes at a heating temperature of 150° C.

Embodiment 3

In the same way as in Embodiment 2, Cryptomerias (B) and (C) were undergone the heating-vacuuming test. The results obtained are shown in Table 2.

First, the test was performed without treating cut ends at the surface temperature of 80° C. for heating time of 120 minutes, the surface temperature of 120° C. for heating time of 120 minutes, and the surface temperature of 150° C. for heating time of 180 minutes. The impregnated amount was 0.4 g/cm$^3$ or more close to 0.5 g/cm$^3$.

Then, the test was performed with cut ends treated at the surface temperature of 50° C. for heating time of 30 minutes, the surface temperature of 50° C. for heating time of 120 minutes, the surface temperature of 80° C. for heating time of 120 minutes, the surface temperature of 110° C. for heating time of 120 minutes, and the surface temperature of 150° C. for heating time of 180 minutes, the impregnated amount was 0.18 g/cm$^3$ or more, indicating remarkable results.

In view of above, it was made certain that the impregnated amount with a vacuuming-pressurizing method level was obtained according to this embodiment.

TABLE 2

| Wood type | Cut end treatment | Heating temp. (° C.) | Heating time (min.) | Impregnated amount (g/cm$^3$) | Quantity of test lumber |
|---|---|---|---|---|---|
| Crypto-meria B | No | Normal temp. (20) | — | 0.25 | 3 |
| | | | 60 | | |
| | | | 120 | | |
| | | 50 | 30 | 0.27 | 2 |
| | | | 60 | | |
| | | | 120 | 0.31 | 3 |
| | | 80 | 30 | | |
| | | | 60 | | |
| | | | 120 | 0.43 | 2 |
| | | 110 | 30 | | 2 |
| | | | 60 | | 2 |
| | | | 120 | 0.40 | 1 |
| | | 150 | 180 | 0.48 | 3 |
| Crypto-meria C | Yes | Normal temp. (20) | — | 0.13 | 2 |
| | | | 60 | | |
| | | | 120 | | |
| | | 50 | 30 | 0.20 | 2 |
| | | | 60 | | |
| | | | 120 | 0.21 | 1 |
| | | 80 | 30 | | |
| | | | 60 | | |
| | | | 120 | 0.18 | 1 |
| | | 110 | 30 | | |
| | | | 60 | | |
| | | | 120 | 0.45 | 1 |
| | | 150 | 180 | 0.54 | 3 |

(Note)
Vacuuming conditions: Vacuuming force of 60 cm/Hg and vacuuming time of 120 minutes
Immersing time: Four hours Embodiment 4

In the same way as in Embodiment 2, a hemlock spruce, a pine (A), a pine (B), a Douglas pine, an Akita cedar, and a mahogany were undergone the heating-vacuuming test. The results obtained are shown in Table 3.

First, when the test was performed without treating cut ends, the test lumbers had the impregnated amount close to 0.5 g/cm$^3$ excepting the pine (A), the pine (B), the Douglas pine and the mahogany.

Then, the test was performed with cut ends treated. The effect was poor on the Douglas pine, while the effect was good on the Akita cedar with the impregnated amounts of 0.10 g/cm$^3$ and 0.26 g/cm$^3$.

In view of above, it was made certain that the impregnated amount with a vacuuming pressurizing method level was obtained according to this embodiment.

TABLE 3

| Wood type | Cut end treatment | Heating temp. (° C.) | Heating time (min.) | Impregnated amount (g/cm$^3$) | Quantity of test lumber |
|---|---|---|---|---|---|
| Helmock spruce | No | 150 | 180 | 0.64 | 6 |
| Pine A | No | 150 | 180 | 0.19 | 3 |
| Pine B | No | 150 | 180 | 0.08 | 3 |
| Douglas Pine | No | 20 | — | 0.17 | 1 |
| | | 50 | 30 | 0.14 | 3 |
| | | | 60 | 0.17 | 3 |
| | | | 120 | 0.20 | 3 |
| | | 80 | 30 | 0.19 | 2 |
| | | | 60 | 0.20 | 3 |
| | | | 120 | 0.18 | 3 |
| | | 110 | 30 | 0.21 | 3 |
| | | | 60 | 0.16 | 3 |
| | | | 120 | 0.17 | 3 |
| | Yes | 20 | — | 0.06 | 3 |
| | | 50 | 30 | 0.04 | 3 |
| | | | 60 | 0.06 | 3 |
| | | | 120 | 0.06 | 3 |
| | | 80 | 30 | 0.07 | 3 |
| | | | 60 | 0.06 | 3 |
| | | | 120 | 0.06 | 3 |
| | | 110 | 30 | 0.06 | 3 |
| | | | 60 | 0.03 | 3 |
| | | | 120 | 0.04 | 2 |
| Akita cedar | No | 20 | — | 0.15 | 4 |
| | | 110 | 120 | 0.51 | 4 |
| | Yes | 20 | — | 0.10 | 3 |
| | | 110 | 120 | 0.26 | 3 |
| Mahogany | No | 150 | 180 | 0.02 | 6 |

(Note)
Vacuuming conditions: Vacuuming force of 60 cm/Hg and vacuuming time of 120 minutes
Immersing time: Four hours Embodiment 5 cedar (D), a Japanese cypress, a hemlock spruce, a Douglas pine and a mahogany having a moisture content of 10 to 15% (corresponding to the equilibrium moisture content) was cut to a size of 30 mm thick, 60 mm wide and 300 mm long and placed into an airtight container 1000 mm high, 1000 mm wide and 4000 mm long, and heated to have the lumber surface temperature of 80° C. for 120 minutes in accordance with the heating-vacuuming test shown Table 4. After heating, the airtight container was vacuumed by a vacuum pump and kept under the atmospheric pressure having a vacuuming force of 60 cm/Hg for 120 minutes.

Then, they were allowed to stand in the air pressure (normal temperature) for 24 hours.

The airtight container was closed, and the lumbers were heated again at the surface temperature of 80° C. for 120 minutes. After the heating process, the airtight container was vacuumed by the vacuum pump and kept to have the atmospheric pressure having a vacuuming force of 60 cm/Hg for 120 minutes.

Then, tap water was charged into the airtight container to immerse the lumbers thoroughly.

The airtight container was then opened to change the pressure in the container to the air pressure. This condition was kept for four hours.

Now, description will be made with reference to Table 4.

First, when the test was performed without treating cut ends, the test lumbers excepting the Douglas pine and the mahogany had remarkable results indicating the impregnated amount of 0.5 g/cm$^3$ or more.

Then, the test was performed with cut ends treated. The effect was good excepting the mahogany with the impregnated amounts of 0.12 g/cm$^3$ or more.

In view of above, it was made certain that the impregnated amount with a vacuuming-pressurizing method level was obtained according to this embodiment.

TABLE 4

| Wood type | Cut end treatment | Heating temp. (° C.) | Heating time (min.) | Impregnated amount (g/cm³) | Quantity of test lumber |
|---|---|---|---|---|---|
| Cedar D | No | 80 | 120 | 0.61 | 16 |
| | Yes | 80 | 120 | 0.48 | 16 |
| Japanese | No | 80 | 120 | 0.60 | 10 |
| cypress | Yes | 80 | 120 | 0.48 | 7 |
| Helmock | No | 80 | 120 | 0.60 | 10 |
| spruce | Yes | 80 | 120 | 0.44 | 9 |
| Douglas | No | 80 | 120 | 0.32 | 6 |
| pine | Yes | 80 | 120 | 0.12 | 4 |
| Mahogany | No | 80 | 120 | 0.09 | 2 |
| | Yes | 80 | 120 | 0.06 | 2 |

(Note)
Vacuuming conditions: Vacuuming force of 60 cm/Hg and vacuuming time of 120 minutes
Immersing time: Four hours Industrial Applicability As described above, lumbers having a moisture content of 10 to 15%, (corresponding to the equilibrium moisture content) can be dried easily into an absolute dry state by heating and vacuuming in the airtight container.

And, it is advantageous that the lumbers are not get cracked and can be dried in a short time.

It is to be understood that any ordinary lumbers having a moisture content of 50 to 70% can also be dried. In that case, there can be obtained the lumbers having a final moisture content of 10 to 20% in two to three days.

Using the methods of the present invention, the lumbers are heated before the vacuuming process, immersed in the processing agents after the vacuuming process and exposed to the air pressure, the processing agents can be impregnated deep into the lumbers owing to the pressure difference. Besides, lumber cells are not destroyed.

Furthermore, since any apparatus can be used if the heating process, vacuuming process and immersing process can be secured, no special apparatus is required, and production can be made inexpensively as compared with a conventional immersing method.

I claim:

1. A lumber drying method, comprising:

a process to place lumber in an airtight container;

a process to apply heat to the lumber within the container;

a process to create a vacuum inside the airtight container; and a process to restore the container to atmospheric air pressure after the vacuum process.

2. The lumber drying method as set forth in claim 1, wherein heating and vacuuming are performed at the same time.

3. The lumber drying method as set forth in claim 1, wherein the process to restore air pressure is made instantaneously by opening a pressure relief valve on the airtight container.

4. The lumber drying method as set forth in claim 1, wherein the lumber has an equilibrium moisture content of 10 to 15%.

5. The lumber drying method as set forth in claim 1, wherein the lumber heating process heats the lumber until the surface temperature reaches 50 to 150° C.

6. The lumber drying method as set forth in claim 1, wherein the vacuuming process has a vacuuming force of about 60 cm/Hg or more and a vacuuming time of at least one hour.

7. The lumber drying method as set forth in claim 1, wherein heat and water vapor are distributed within the airtight container by stirring with a fan inside the airtight container during the process to apply heat to the lumber.

8. The lumber drying method as set forth in claim 1, wherein heat and water vapor are distributed within the airtight container by stirring with a fan inside the airtight container during a combined heat and vacuum process.

9. A lumber impregnation method, comprising:

a process to apply heat to lumber;

a process to subject the heated lumber to a vacuumed pressure;

a process to immerse the heated lumber in processing agents at the vacuumed pressure; and a process to restore the lumber immersed in processing agents at the vacuumed pressure to atmospheric air pressure while continuing to immerse the lumber in the processing agents.

10. A lumber impregnation method, comprising:

a process to apply heat to lumber;

a process to subject the heated lumber to a vacuumed pressure;

a process to return the lumber at the vacuumed pressure to atmospheric air pressure;

a process to reapply heat to the lumber;

a process to subject the reheated lumber to a vacuumed pressure;

a process to immerse the reheated lumber in processing agents at the vacuumed pressure; and a process to restore the lumber immersed in the processing agents at the vacuumed pressure to atmospheric air pressure while continuing to immerse the lumber in the processing agents.

11. The lumber impregnation method as set forth in claim 9 or 10, wherein the process to apply heat to the lumber heats the lumber to a surface temperature of 50 to 150° C.

12. The lumber impregnation method as set forth in claim 9 or 10, wherein the process to subject the heated lumber to a vacuumed pressure has a vacuuming force of about 60 cm/Hg or more and a vacuuming time of at least one hour.

13. The lumber impregnation method as set forth in claim 9 or 10, wherein the process to restore air pressure is made instantaneously.

14. The lumber impregnation method as set forth in claim 9 or 10, wherein the process to apply heat to the lumber stirs air with a fan to distribute heat and water vapor in a processing apparatus.

15. The lumber impregnation method as set forth in claim 9 or 10, wherein the lumber is pressurized in a processing apparatus after immersion in processing agent at atmospheric pressure.

16. The lumber impregnation method as set forth in claim 9 or 10, wherein a combined heat and vacuum process stirs air with a fan to distribute heat and water vapor in a processing apparatus.

17. The lumber impregnation method as set forth in claim 10, wherein the process to reapply heat to the lumber and the process to subject the reheated lumber to a vacuumed pressure are repeated at least once.

* * * * *

UNITED STATES PATENT AND TRADEMARK OFFICE

CERTIFICATE OF CORRECTION

PATENT NO. : 5,970,624

DATED : October 26, 1999

INVENTOR(S) : Kazuo Moriya

It is certified that error appears in the above-identified patent and that said Letters Patent is hereby corrected as shown below:

Please amend the cover page of the patent as follows:

| | |
|---|---|
| **[75] Inventor:** | Replace "Tokorozawa, Japan"<br>With --Tokorozawa-shi, Japan-- |
| **[73] Assignee:** | Replace "Common Facility Co-operative Forest Nishikawa"<br>With --Common Facility Co-operative Forest Nishikawa (1/3) and Emiko Moriya (1/3)-- |
| **Column 1, line 11** | Replace "mothproofingg"<br>With --mothproofing-- |
| **Column 2, line 46** | Replace "(13),"<br>With --(13);-- |
| **Column 3, line 47** | Replace "process"<br>With --comprises a process to heat lumbers, a process-- |
| **Column 5, line 10** | Replace "(are"<br>With --are-- |
| **Column 5, line 65** | Replace "described"<br>With --described hereinabove-- |
| **Column 6, line 17** | Replace "invention."<br>With --invention;-- |

UNITED STATES PATENT AND TRADEMARK OFFICE

CERTIFICATE OF CORRECTION

PATENT NO. : 5,970,624

DATED : October 26, 1999

INVENTOR(S) : Kazuo Moriya

It is certified that error appears in the above-identified patent and that said Letters Patent is hereby corrected as shown below:

| | |
|---|---|
| **Column 7, line 20** | Replace "on off"<br>With --on-off-- |
| **Column 8, line 48** | Replace "stilling"<br>With --stirring-- |
| **Column 8, line 62** | Replace "water soluble"<br>With --water-soluble-- |
| **Column 8, line 63** | Replace "moth proofing"<br>With --moth-proofing-- |
| **Column 9, line 11** | Replace "17"<br>With --37-- |
| **Column 9, line 30** | Replace "heating-vacuum"<br>With --heating-vacuuming-- |
| **Column 9, line 51** | Replace "impregnation treated"<br>With --impregnation-treated-- |

UNITED STATES PATENT AND TRADEMARK OFFICE

CERTIFICATE OF CORRECTION

PATENT NO. : 5,970,624

DATED : October 26, 1999

INVENTOR(S) : Kazuo Moriya

It is certified that error appears in the above-identified patent and that said Letters Patent is hereby corrected as shown below:

| | |
|---|---|
| **Column 12, line 36** | Replace "cedar"<br>With --A cedar-- |
| **Column 12, line 40** | Replace "container 1000"<br>With --container of 1000-- |
| **Column 12, line 43** | Replace "shown Table 4."<br>With --shown in Table 4.-- |
| **Column 13, line 24** | Replace "15%,"<br>With --15%-- |

Signed and Sealed this

Tenth Day of April, 2001

*Attest:*

Nicholas P. Godici

NICHOLAS P. GODICI

*Attesting Officer*

*Acting Director of the United States Patent and Trademark Office*